US010731103B2

(12) United States Patent
Emert et al.

(10) Patent No.: US 10,731,103 B2
(45) Date of Patent: Aug. 4, 2020

(54) LOW ASH AND ASH-FREE ACID NEUTRALIZING COMPOSITIONS AND LUBRICATING OIL COMPOSITIONS CONTAINING SAME

(71) Applicant: Infineum International Limited, Abingdon (GB)

(72) Inventors: Jacob Emert, Brooklyn, NY (US); Rachel Tundel, Brooklyn, NY (US); Peter Wright, Faringdon (GB); Sandip Agarwal, Arlington, MA (US); Xinhua Li, Newton, MA (US); Joseph McLellan, Quincy, MA (US); Patrick Reust, Somerville, MA (US)

(73) Assignee: Infineum International Limited, Abingdon, Oxfordshire (GB)

( * ) Notice: Subject to any disclaimer, the term of this patent is extended or adjusted under 35 U.S.C. 154(b) by 9 days.

(21) Appl. No.: 15/837,010

(22) Filed: Dec. 11, 2017

(65) Prior Publication Data

US 2019/0177650 A1 Jun. 13, 2019

(51) Int. Cl.

| | |
|---|---|
| ***C10M 169/04*** | (2006.01) |
| ***C10M 105/00*** | (2006.01) |
| ***C10M 149/22*** | (2006.01) |
| ***C10M 139/00*** | (2006.01) |
| ***C10M 143/00*** | (2006.01) |
| ***C10M 161/00*** | (2006.01) |
| ***C10M 157/04*** | (2006.01) |
| ***C10M 133/06*** | (2006.01) |
| ***C10M 171/06*** | (2006.01) |

(52) U.S. Cl.

CPC ..... *C10M 169/044* (2013.01); *C10M 105/00* (2013.01); *C10M 133/06* (2013.01); *C10M 139/00* (2013.01); *C10M 143/00* (2013.01); *C10M 149/22* (2013.01); *C10M 157/04* (2013.01); *C10M 161/00* (2013.01); *C10M 169/041* (2013.01); *C10M 171/06* (2013.01); *C10M 2203/003* (2013.01); *C10M 2205/02* (2013.01); *C10M 2215/04* (2013.01); *C10M 2217/046* (2013.01); *C10M 2227/06* (2013.01); *C10N 2220/021* (2013.01); *C10N 2220/082* (2013.01); *C10N 2230/04* (2013.01); *C10N 2230/45* (2013.01); *C10N 2230/52* (2013.01); *C10N 2240/10* (2013.01); *C10N 2250/02* (2013.01); *C10N 2250/12* (2013.01); *C10N 2250/16* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,087,936 | A | 4/1963 | LeSuer | |
| 3,172,892 | A | 3/1965 | LeSuer | |
| 3,215,707 | A | 11/1965 | Rense | |
| 3,231,587 | A | 1/1966 | Rense | |
| 3,272,746 | A | 9/1966 | LeSuer | |
| 3,275,554 | A | 9/1966 | Wagenaar | |
| 3,381,022 | A | 4/1968 | LeSuer | |
| 3,442,808 | A | 5/1969 | Traise | |
| 3,565,804 | A | 2/1971 | Honnen | |
| 3,912,764 | A | 10/1975 | Palmer, Jr. | |
| 4,110,349 | A | 4/1978 | Cohen | |
| 4,102,798 | A | 7/1978 | Ryer et al. | |
| 4,113,639 | A | 9/1978 | Lonstrup et al. | |
| 4,116,876 | A | 9/1978 | Brois et al. | |
| 4,152,499 | A | 5/1979 | Boerzel et al. | |
| 4,234,435 | A | 11/1980 | Meinhardt et al. | |
| 4,857,217 | A | 8/1989 | Gutierrez et al. | |
| 4,927,551 | A | 5/1990 | Erdman et al. | |
| 4,938,881 | A | 7/1990 | Ripple et al. | |
| 4,952,739 | A | 8/1990 | Chen | |
| 4,956,107 | A | 9/1990 | Gutierrez et al. | |
| 4,963,275 | A | 10/1990 | Gutierrez et al. | |
| 5,053,152 | A | 10/1991 | Steckel | |
| 5,229,022 | A | 7/1993 | Song et al. | |
| 5,230,714 | A | 7/1993 | Steckel | |
| 5,241,003 | A | 8/1993 | Degonia et al. | |
| 5,498,809 | A | 3/1996 | Emert et al. | |
| 5,565,128 | A | 10/1996 | Gutierrez | |
| 5,663,130 | A | 9/1997 | Emert et al. | |
| 5,705,577 | A | 1/1998 | Rossi et al. | |
| 5,756,431 | A | 5/1998 | Emert et al. | |
| 5,777,025 | A | 7/1998 | Spencer et al. | |
| 5,792,730 | A | 8/1998 | Gutierrez et al. | |
| 5,814,715 | A | 9/1998 | Chen et al. | |
| 5,854,186 | A | 12/1998 | Cusumano et al. | |
| 5,891,953 | A | 4/1999 | Spencer et al. | |
| 6,022,929 | A | 2/2000 | Chen et al. | |
| 6,030,930 | A | 2/2000 | Emert et al. | |
| 8,143,201 | B2 | 3/2012 | Emert et al. | |
| 8,703,682 | B2 | 4/2014 | Hartley et al. | |
| 9,145,530 | B2 | 9/2015 | Bera et al. | |
| 2007/0203031 | A1 | 8/2007 | Bardasz et al. | |
| 2007/0298351 | A1* | 12/2007 | Shimada | B41C 1/1016 430/281.1 |
| 2010/0221460 | A1* | 9/2010 | Wexler | B41M 5/5218 428/32.1 |

(Continued)

FOREIGN PATENT DOCUMENTS

| | | | |
|---|---|---|---|
| CA | 1335895 | C | 6/1995 |
| EP | 0382450 | B1 | 8/1990 |

(Continued)

*Primary Examiner* — Ellen M McAvoy
*Assistant Examiner* — Chantel L Graham

(57) ABSTRACT

An oleaginous nanoparticle dispersion of nanoparticles having a core of an organic base material immobilized within a surfactant layer, the use thereof as a low ash, or ash-free source of TBN in lubricating oil compositions, and lubricating oil compositions formulated with such oleaginous nanoparticle dispersions.

28 Claims, No Drawings

(56) References Cited

U.S. PATENT DOCUMENTS

| | | | | |
|---|---|---|---|---|
| 2017/0139339 | A1* | 5/2017 | Rosenthal | C09D 11/033 |
| 2018/0362834 | A1* | 12/2018 | Haghighi | C09K 8/584 |

FOREIGN PATENT DOCUMENTS

| | | | |
|---|---|---|---|
| EP | 0208560 | B2 | 12/1998 |
| GB | 989409 | | 4/1965 |
| GB | 1440219 | | 6/1976 |

* cited by examiner

LOW ASH AND ASH-FREE ACID NEUTRALIZING COMPOSITIONS AND LUBRICATING OIL COMPOSITIONS CONTAINING SAME

The present invention relates to low ash, or ash-free (metal-free) acid neutralizing compositions and internal combustion engine crankcase lubricating oil compositions containing same. More specifically, the present invention is directed to materials that effectively provide basicity (acid neutralization) to lubricating oil compositions, without introducing sulfated ash, and exhibit minimal corrosiveness and good compatibility with fluoroelastomeric materials commonly used to form internal combustion engine seals.

BACKGROUND OF THE INVENTION

The contamination of engine oils with the acidic byproducts of combustion is one of the major causes/drivers of engine corrosion and wear. Neutralization of these acidic species has conventionally been addressed by the addition of metal carbonate overbased detergents, such as calcium carbonate ($CaCO_3$) overbased detergents, which have been found to be highly effective at neutralizing these acids. However, the use of highly overbased metal detergents has several drawbacks. Specifically, the incorporation of overbased metal detergents increases the sulfated ash (SASH) content of the lubricating oil compositions resulting in increased fuel consumption and exhaust back-pressure on after treatment devices such as diesel particulate filters.

Several attempts have been made to provide metal-free (ashless) sources of TBN that can be used as a replacement for at least a portion of the overbased metal detergent, however, these alternatives have achieved only limited success. US Patent Application 2007/0203031 suggests the use of low molecular weight, high TBN (total base number) succinimide dispersants as ashless TBN sources, however, these highly basic compounds have been found to have adverse effects on engine corrosion and on the fluoroelastomeric materials commonly used to form engine seals. U.S. Pat. Nos. 8,703,682; 8,143,201 and 9,145,530 suggest the use of phenylenediamine compounds, morpholine compounds and hindered amines, respectively, as ashless TBN sources for lubricating oil compositions.

Conflicting industry demands for lubricants having reduced sulfated ash contents (requiring reduced amounts of metal detergent overbasing) on the one hand, and lubricants having longer effective lives with increased acid-neutralizing capacity (requiring greater TBN contribution) on the other provide a strong need for ashless TBN sources that can be used as an alternative to conventional overbased metal detergents and provide a high level of acid neutralization.

SUMMARY OF THE INVENTION

In accordance with a first aspect of the invention, there is provided nanoparticles comprising an organic basic core immobilized within a semi-permeable surfactant layer.

In accordance with a second aspect of the invention, there is provided nanoparticles, as in the first aspect, wherein the organic basic core is formed of polyamine.

In accordance with a third aspect of the invention, there is provided nanoparticles, as in the first or second aspect, wherein the polyamine core is crosslinked.

In accordance with a fourth aspect of the invention, there is provided nanoparticles as in the first, second or third aspect, wherein the basic core is derived from a polyamine precursor of molecular weight of from about 100 Daltons to about 100,000 Daltons.

In accordance with a fifth aspect of the invention, there is provided nanoparticles, as in the first, second, third or fourth aspect, in the form of an oleaginous nanoparticle dispersion.

In accordance with a sixth aspect of the invention, there is provided an oleaginous nanoparticle dispersion, as in the fifth aspect, wherein the dispersion has a TBN as measured in accordance with ASTM D4739 of from about 50 to about 900 mg KOH/g on an active ingredient ("A.I."; oil-free) basis.

In accordance with a seventh aspect of the invention, there is provided a lubricating oil composition for an internal combustion engine, comprising an oleaginous nanoparticle dispersion, as in the fifth or sixth aspect, in an amount contributing at least about 0.5 mg KOH/g of TBN to the lubricating oil composition.

Other and further objectives, advantages and features of the present invention will be understood by reference to the following specification.

DETAILED DESCRIPTION OF THE INVENTION

The present invention is directed to ashless, or low ash sources of TBN useful in the formulation of engine crankcase lubricating oil compositions. Specifically, the present invention is directed to nanoparticles, conveniently provided in the form of an oleaginous nanoparticle dispersion, which nanoparticles comprise a basic organic core immobilized within a semi-permeable surfactant layer, and engine crankcase lubricating oil compositions containing same. The semipermeable surfactant layer allows lubricating oil and associated acidic combustion by-products to contact the basic core to be neutralized, while ameliorating the metal corrosion and engine seals compatibility issues normally associated with basic engine additive compositions.

The core of the nanoparticles (which can alternatively be described as microemulsions, microspheres or nanospheres) is formed of an organic base, which in an engine oil provides acid neutralizing performance by reaction with acidic byproducts of combustion such as sulphur oxides and nitric oxides. The core is formed from a basic amine precursor which could contain additional functional groups such as alcohol or amide groups, or mixtures thereof. Useful amine compounds comprise at least one amine group and can also comprise one or more additional amine groups or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, carbonyls, imidazoline groups, and the like. Suitable hydrocarbyl amines include aryl, cycloalkyl and alkylamines. Particularly useful amine compounds include mono- and polyamines, e.g., polyalkylene and polyoxyalkylene polyamines having, or having on average, about 2 to 1000, such as 2 to 100, preferably 2 to 40 (e.g., 3 to 20) total carbon atoms and/or about 1 to 400, preferably about 2 to 100 or about 2 to 40, such as about 3 to 12, more preferably about 3 to 9, most preferably from about 6 to about 7 nitrogen atoms per molecule. Polymeric polyethylene imines are available commercially and could be used as a core material or core precursor. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl) cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152.

Due to the nanoparticle structure, a large hydrocarbyl group is not needed to solubilize the amine in the lubricating oil. Therefore, the hydrocarbyl group of the hydrocarbyl amine may have from only 1 to about 20 carbon atoms. The smaller size of the hydrocarbyl group allows the aminic core to have a high total base number, such as a TBN of 50 mg KOH/g or more on A.I. basis.

To maintain the integrity of the nanoparticle core in use, the organic base material is at least partially crosslinked with a crosslinking agent. Crosslinking agents are typically compounds having at least two independently selected functional groups capable of reacting with the amine groups of the core precursor. Examples of such functional groups are carbonyl, epoxy, ester, acid anhydride, acid halide, isocyanate, vinyl and chloroformate groups. Crosslinking, within the confines of this invention, is the building of molecular weight through the formation of bonds between the basic species (e.g. polyamine) and a cross-linking agent (e.g. epoxide). Crosslinking may span from a single multi-epoxide species reacting with 2 or more amine moieties, through to a full network structure where there is, in effect, one polymer chain as all the polyamines have been joined together. The cross-linking agent may produce a link between polymer chains that is distinguishable or indistinguishable from the main chain (i.e. the amine). The linking group between chains may have one or more atoms.

The degree of crosslinking can result in the core material being substantially liquid, gel or solid. The molar ratio of reactive groups on a crosslinking agent to organic base material (e.g. basic nitrogen groups on a polyamine molecule) controls the physical state of the core, as well as the crosslinking density. Too low a ratio may lead to insufficient crosslinking, which may result in a less stable dispersion and/or increased corrosion or seals aggresiveness, while too high a ratio may result in a less stable dispersion. Optimization may be required for any new combination of organic basic material and crosslinking agent, since the functionality of either can influence the extent of gel formation. Generally, however, the molar ratio of reactive functional groups (i.e. reactive equivalents) on the crosslinking agent to reactive organic base material will be on the order of from about 0.1 mol % to about 80 mol % such as from about 0.5 mol % to about 40 mol %, or from about 1.0 mol % to about 30 mol %. Generally, from about 0.5 mol % to about 30 mol %, preferably, from about 1.0 mol % to about 20 mol % of the organic basic material that constitutes the precursor core of the nanoparticle is crosslinked.

A surfactant (a contraction of the term surface active agent) is that substance that, when present at low concentration in a system, has the property of adsorbing onto the surfaces and interfaces of the system and of altering to a marked degree the surface or interfacial free energies of those surfaces (or interfaces). The term interface indicates a boundary between any two immiscible phases. In the context of the present invention, surfactants are added to stabilize the oleaginous nanoparticle dispersion and act on the interface between the amine and oil so that the droplets of amine are stabilized. Surfactants are classified by the charge carried on the hydrophilic (water-soluble) portion of the molecule. Thus, for example, simple fatty acid amides ($R—CONH_2$) are non-ionic surfactants.

Surfactants useful in the context of the present invention include non-ionic surfactants, anionic surfactants, cationic surfactants, or polymeric surfactants. Non-ionic surfactants are amphiphilic compounds in which the lyophilic and hydrophilic parts do not dissociate into ions and hence have no charge. However, there are non-ionics, for example tertiary amine-oxides, which are able to acquire a charge depending on the pH value. Anionic surfactants are amphiphilic substances that include an anionic group as an obligatory component attached directly or through intermediates to a long hydrocarbon chain. Most commercial anionic surfactants are generally inhomogeneous mixtures with respect to both the composition and hydrocarbon chain length since the purity is often not crucial for their performance. Cationic surfactants are amphiphilic substances that include a cationic group as an obligatory component attached directly or through intermediates to a long hydrocarbon chain. A polymeric surfactant is a macromolecule which has hydrophilic and hydrophobic components in such a ratio that they adsorb at interfaces altering the surface or interfacial properties of the system.

The surfactants of the present invention must stabilize the nanoparticle over a wide temperature range and thus, should not have a phase inversion temperature (PIT; —temperature of inversion from water-in-oil to oil-in-water) within the operating temperatures of an engine (−35 to 300° C.). The surfactants are preferably either ionic or non-ionic, with the proviso that non-ionic surfactants suitable for use in the context of the present invention are limited to those that can be crosslinked to the organic basic material of the core. The preferred surfactants have a HLB (hydrophilic-lipophilic balance) value of from about 0.1 to about 6, such as from about 0.5 to about 6, more preferably from about 0.5 to about 5.75, such as from about 0.5 to about 5.5.

Suitable ionic surfactants include those used as the soap of conventional, neutral lubricant detergents, including sulfonates, phenates, sulfurized and methylene bridged phenates, thiophosphonates, salicylates, naphthenates and other oil soluble salts of a metal, particularly the alkali or alkaline earth metals, e.g., barium, sodium, potassium, lithium, calcium, and magnesium. Sulfonates are preferred and the most commonly used metals are calcium, magnesium, and sodium.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides and nitrates of the metal.

Metal salts of phenols and sulfurized or methylene bridged phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylates, e.g., salicylates, can be prepared by reacting aromatic carboxylic acid with an appropriate metal compound such as an oxide or hydroxide and neutral or overbased products may be obtained by methods well known in the art. The aromatic moiety of the aromatic carboxylic acid can contain hetero atoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl-substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with non-carboxylated phenol. Preferred substituents in oil soluble salicylic acids are alkyl substituents. In alkyl substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility. The above metal salts preferably have a metal content of less than 15 mass %, such as less than 7.5 mass %, more preferably less than 5 mass %, based on the total mass of the surfactant.

Suitable non-ionic surfantants that can be crosslinked to the organic basic material of the core include polyalkenyl succinimides or polyolefins grafted with amino-succinide groups such as Hitec 5777 (available from Afton Chemical Co.).

Suitable non-ionic surfactants are olefin and ethylene-α-olefin polymers functionalized with a group that can be crosslinked to the core. Specifically, such non-ionic surfantants are polyalkenyl oligomers or polymers substituted with one or more carboxylic acid groups, or anhydrides thereof, as well as polyalkenyl oligomers or polymers having one or more amine, amine-alcohol or amide polar moieties attached to the polymer backbone, often via a bridging group. Such non-ionic surfactants may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine. Such non-ionic surfactants may be similar, or identical in structure to ashless dispersant components conventionally used in the formulation of lubricating oil compositions and particularly suitable non-ionic surfantants that can be crosslinked to the organic basic material of the core include polyalkenyl succinimides or polyolefins grafted with amino-succinide groups such as Hitec 5777™ (available from Aflon Chemical Co.).

The polyalkenyl moiety of the non-ionic surfactant may have a number average molecular weight of from about 700 to about 3000, preferably between 950 and 3000, such as between 950 and 2800, more preferably from about 950 to 2500 daltons. The molecular weight of such non-ionic surfactants is generally expressed in terms of the molecular weight of the polyalkenyl moiety as the precise molecular weight range of the surfactant depends on numerous parameters including the type of polymer used to derive the surfactant, the number of functional groups, and the type of nucleophilic group employed.

Suitable hydrocarbons or polymers employed in the formation of the non-ionic surfactants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ or $H_2C{=}CR^1R^2$ wherein each of $R^1$ and $R^2$ are straight or branched chain alkyl radicals comprising 1 to 26 carbon atoms and wherein the polymer contains carbon-to-carbon unsaturation, preferably a high degree of terminal vinyl or ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1,4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are copolymers of ethylene and propylene and ethylene and butene-1. The interpolymers of this invention may contain a minor amount, e.g. 0.5 to 5 mole % of a $C_4$ to Cis non-conjugated diolefin comonomer.

These polymers may be prepared by polymerizing alpha-olefin monomer, or mixtures of alpha-olefin monomers, or mixtures comprising ethylene and at least one $C_3$ to $C_2$ alpha-olefin monomer, in the presence of a Ziegler-Natta catalyst system or a catalyst system comprising at least one metallocene (e.g., a cyclopentadienyl-transition metal compound) and an alumoxane compound. Using this process, a polymer in which 95% or more of the polymer chains possess terminal vinyl or ethenylidene-type unsaturation can be provided. The percentage of polymer chains exhibiting terminal vinyl or ethenylidene unsaturation may be determined by FTIR or NMR spectroscopic analysis. Interpolymers of this latter type may be characterized by the formula POLY-C($R^1$)=$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-CH=$CH_2$, and a portion of the polymers can contain internal monounsaturation, e.g. POLY-CH=CH($R^1$), wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 20 to about 60 mass %, in the presence of a Lewis acid catalyst, such as aluminum trichloride or boron trifluoride. A preferred source of monomer for making poly-n-butenes is petroleum feed streams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available e.g. under the tradename Glissopal™ (from BASF).

Polyisobutylene polymers that may be employed are generally based on a hydrocarbon chain of from about 700 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A-1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinal, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

The functionalized oil-soluble polymeric hydrocarbon backbone may then be derivatized with a nitrogen-containing nucleophilic reactant, such as an amine, amino-alcohol, amide, or mixture thereof, to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl) cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

Another class of suitable non-ionic surfactants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

Particularly preferred are polybutenyl succinimides that are the reaction product of a polyamine and polybutenyl succinic anhydride (PIBSA) derived from polybutene having a number average molecular weight ($M_n$) of greater than about 1300, 1500, and preferably greater than 1800 daltons, and less than about 2500 such as less than about 2400 daltons, where the polybutenyl succinic anhydride (PIBSA) is derived from polybutene having a terminal vinylidene content of at least about 50%, 60%, or 70%, preferably at least about 80%, and succinic and/or maleic anhydride via an "ene" or thermal maleation process.

These preferred dispersants have a functionality of from about 1.1 to about 2.2, preferably from about 1.3 to about 2.2, such as a functionality of from about 1.4 to about 2.0, more preferably from about 1.5 to about 1.9. Functionality (F) can be determined according to the following formula:

$$F=(\mathrm{SAP}\times M_n)((1122\times \mathrm{A.I.})-(\mathrm{SAP}\times \mathrm{MW})) \quad (1)$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer (polybutene); A.I. is the percent active ingredient of the succinic-containing reaction product (the remainder being unreacted polybutene and diluent); and MW is the molecular weight of the dicarboxylic acid-producing moiety (98 for maleic anhydride). Generally, each dicarboxylic acid-producing moiety (succinic group) will react with a nucleophilic group (polyamine moiety) and the number of succinic groups in the PIBSA will determine the number of nucleophilic groups in the finished dispersant.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

The ratio (mass %:mass %) of core to surfactant may be from about 0.1:1 to about 24:1, such as from about 0.2 to about 24; preferably from about 0.5 to about 20. The nanoparticles may have an average particle size of from about 5 nm to about 3000 am, such as from about 10 nm to about 1500 nm, preferably from about 10 nm to about 1000 nm, such as from about 10 nm to about 600 nm. Average particle size can be measured via Transmission electron microscopy (TEM).

Transmission electron microscopy (TEM) can be used to determine the size of the individual particles in a dispersion concentrate. As the sample is an oleaginous dispersion, care must be taken to prepare samples where the particles can be readily discerned and oily residues are minimized. A typical sample is prepared and particle size determination proceeds according to the following steps:

1. Preparation of 0.1 wt. % dilution of dispersion
   a. 0.01 grams of concentrated dispersion (such as the product of example 1) is weighed out in a glass 20 ml vial
   b. 9.99 grams of toluene is added to the vial to achieve a 0.1 mass % solution of the concentrate
   c. The solution is mixed thoroughly with bath sonicator and vortexer until the concentrate is fully dispersed in the toluene
2. Preparation of TEM grid
   a. A micropipette is used to drop 10 uL of the 0.1 mass % dilution from step 1 onto a TEM grid (Electron Microscopy Sciences product number: CF300-CU) and allowed to rest for 10 seconds
   b. A Kimwipe® is used to wick away excess toluene
   c. The toluene is then allowed to completely evaporate, about 30-60 min
3. Imaged in a TEM (e.g. JEOL 2010F) using 80 kV accelerating voltage and 5 k-100 k magnification
   a. Representative images of the particles on the grid are collected from at least 3 different regions of the grid, such that at least 100 individual particles can be clearly seen and measured
   b. From the images, the diameter of at least 100 individual particles is measured and used to calculate the average particle size and standard deviation.

The rate of particle sedimentation decreases with particle size. Further, optical transparency (of the oleaginous nanoparticle dispersion) is more easily achieved with particle sizes of less than about 200 nm. UV-Vis measurements can be used to characterize the optical transparency of the dispersion concentrates which is related to the degree of aggregation or agglomeration. Initial UV-Vis measurements can be correlated to particle size, and reduced transmission as a function of time can indicate agglomeration or particle growth (e.g. through either a ripening effect, or coalescence, or flocculation). The particle dispersion as prepared is too concentrated for direct UV-Vis measurements, and must be diluted down to about 1 mass % concentrate in base oil for an accurate and reproducible measurement. For example, a typical measurement proceeds by the following steps:

1. Preparation of a 1 mass % sample for UV-Vis measurement
   a. 0.05 grams of concentrated nanoparticle dispersion are weighed out into a tared 20 mL glass vial
   b. 4.95 grams of base oil (e.g. Chevron 100R) are added to yield a 1 mass % solution of the dispersion concentrate in base oil
   c. The solution is mixed thoroughly with bath sonicator and vortexer until the concentrate is fully dispersed in the base oil
2. UV-Vis measurement of the 1 mass % solution
   a. A cuvette with a 1 cm path length is filled with the same base oil that was used to dilute the concentrate (e.g. Chevron 100R), and a background scan for extinction over the range of 400-800 nm is recorded in a spectrophotometer (e.g. Jasco V-630 Spectrophotometer)
   b. A cuvette with a 1 cm path length is then filled with the 1 mass % solution from step 1 and the extinction over the range of 400-800 nm is recorded with the spectrophotometer and the average extinction value over the range of 400-800 nm is calculated and reported as % transmission.

The nanoparticles of the present invention are preferably provided in the form of an oleaginous nanoparticle dispersion. Such an oleaginous nanoparticle dispersion may comprise from about 5 mass % to about 75 mass %, such as from about 10 mass % to about 60 mass %, preferably, from about 15 mass % to about 50 mass %, such as from about 20 mass % to about 45 mass % of the nanoparticles dispersed in a diluent oil. The oleaginous nanoparticle dispersion can have a TBN of from about 50 mg KOH/g to about 900 mg KOH/g, such as from about 75 mg KOH/g to about 800 mg KOH/g, preferably from about 100 mg KOH/g to about 700 mg KOH/g, such as from about 200 mg KOH/g to about 650 mg KOH/g, as measured in accordance with ASTM D4739 (on an oil free active ingredient basis)

The active ingredient (A.I.) of a dispersion can be calculated using Equation 3, below; and the TBN of a dispersion can be calculated using Equation 4, below. The active ingredient is defined as the sum of the masses of the material in the core+surfactant of the particles in the dispersion divided by the sum of the total mass of the dispersion and then multiplied by 100. An example calculation can be seen in Equation 5, which uses data from Example 1, below. The TBN is calculated by determining the mass percent of the dispersion that is polyamine and multiplying that by the TBN of the pure polyamine. An example is shown below in Equation 6.

$$AI = \left(\frac{\text{g Amine} + \text{g water} + \text{g surfactant} + \text{g crosslinker}}{\text{g oil} + \text{g Amine} + \text{g water} + \text{g surfactant} + \text{g crosslinker}}\right) * 100 \quad \text{(Equation 3)}$$

An example TBN of the active ingredient is calculated using Equation 4 below.

$$TBN = \frac{\text{g polyamine}}{\text{g dispersion}} * TBN \text{ of polyamine} \quad \text{(Equation 4)}$$

$$AI = \left(\frac{60 \text{ g Amine} + 20 \text{ g water} + 10 \text{ g surfactant} + 20.01 \text{ g crosslinker}}{110 \text{ g oil} + 60 \text{ g Amine} + 20 \text{ g water} + 10 \text{ g surfactant} + 20.01 \text{ g crosslinker}}\right) * 100 \quad \text{(Equation 5)}$$

$$A.I. = 50 \text{ wt } \%$$

-continued $$TBN = \frac{60\text{ g Amine}}{220.01\text{ g dispersion}} * \frac{1.257\text{ g KOH}}{\text{g oil}} = \frac{343\text{ mg KOH}}{\text{g oil}} \quad \text{(Equation 6)}$$

These formulas can also be used to calculate the A.I. mass % for other dispersions.

The oleaginous nanoparticle dispersions of the present invention may be produced by introducing the surfactant material (either ionic or non-ionic) into a suitable oleaginous medium with heat (e.g., 20° C. to 150° C.) and stirring until the surfactant is fully dissolved. Preferably, the surfactant will be dissolved under inert conditions, such as under a nitrogen blanket. The organic base material is then added to the surfactant solution with continued mixing, preferably using high energy mixing, ultrasound or a microfluidizer, followed by addition of the crosslinking agent. The resulting solution can then be held at temperature for a time sufficient to allow for the complete reaction of the crosslinking agent.

The targeted TBN (as determined by ASTM D2896) and sulfated ash (SASH) content (as determined by ASTM D-874) of lubricating oil compositions formulated with oleaginous nanoparticle dispersions of the present invention will depend on the application. Specifically, a passenger car motor oil will preferably have a TBN of at least 3 mg KOH/g, such as from about 4 to about 15 mg KOH/g, more preferably, a TBN of at least 5 mg KOH/g, such as from about 6 or 7 to about 12 mg KOH/g, and a SASH content of about 0.1-2 mass %, preferably about 0.2-1.8 mass %, more preferably about 0.3-1.5 mass %, such as 0.4-1.2 mass %. A crankcase lubricant for a heavy duty diesel (HDD) engine will generally have a TBN of about 3 to about 20 mg KOH/g, more preferably, a TBN of about 4 mg KOH/g, to about 16 mg KOH/g and a SASH content of about 3 mass % or less, preferably about 2 mass % or less, more preferably about 1.5 mass % or less, such as 1.25 mass % or less. A marine diesel trunk piston engine oil (TPEO) will preferably have a TBN of at least 15 mg KOH/g, such as from about 15 to about 60 mg KOH/g more preferably, a TBN of at least 20 mg KOH/g, such as from about 20 to about 55 mg KOH/g, and a marine diesel crosshead engine lubricant (MDCL) will preferably have a TBN of at least 20 mg KOH/g, such as from about 20 to about 200 mg KOH/g, more preferably, a TBN of at least 30 mg KOH/g, such as from about 40 to about 180 mg KOH/g.

Preferably, any of the fully formulated lubricating oil compositions described above will derive at least 5%, preferably at least 10%, more preferably at least 20% of the compositional TBN (as measured in accordance with ASTM D2896) from the oleaginous nanoparticle dispersions of the present invention. Preferably any of the fully formulated lubricating oil compositions described above will contain an amount of the oleaginous nanoparticle dispersions of the present invention contributing at least about 0.5 mg KOH/g, preferably at least about 1 mg KOH/g of TBN (ASTM D2896) to the composition. The compositional TBN not contributed by the oleaginous nanoparticle dispersions of the present invention may come from conventional overbased metal detergent and other conventional basic lubricant additives, such as dispersants.

This invention will be further understood by reference to the following examples, wherein all parts are parts by weight, unless otherwise noted and which include preferred embodiments of the invention.

EXAMPLES

Examples 1-6 are processes that result in stable nanoparticle dispersions of the present invention.

Example 1—Reacting the Cross-Linking Agent Before Emulsifying (Preferred)

60.0 g of Huntsman Ethyleneamine E-100 was combined with 22.01 g of trimethylolpropane triglycidyl ether (cross-linking agent). In a separate vessel, 100.0 g of Chevron 100R was combined with 20.0 g of a magnesium salt of a branched alkyl benzene sulfonate, an anionic surfactant which is 50% active ingredient in 50% AMEXOM100 base oil. The surfactant solution was thoroughly mixed until homogenous with the aid of heat. The E-100 solution was allowed to react to completion at 65° C. under constant stirring from an overhead mixer. After one hour, the reaction had completed, and 20.0 g of distilled water was added to the E-100 containing solution. Mixing the E-100 containing solution and distilled water caused the solution to heat up, so the solution was allowed to cool back to room temperature (i.e. 18-22° C.). When cool, the surfactant solution was added to the aqueous solution under constant mixing. The mixture was then dispersed with high energy mixing using an M-110P Microfluidizer at 20-30 kPsi and a F20Y interaction chamber. A temperature controller was used to vary the temperature of the bath that surrounds the outlet coil and was set to 50° C. with the solution exiting the outlet coil at around 46° C. This microfluidized solution will be referred to as the nanoparticle dispersion. This nanoparticle dispersion was collected in a separate vessel and run through the Microfluidizer another three additional passes and the final product was collected. An aliquot was taken from the final product to monitor stability at room temperature and 50° C. using the UV-Vis Transmission procedure outlined above. A 1 mass % dilution of the concentrated nanoparticle dispersion in Chevron 100R had an initial average UV-Vis transmission of 78%. Storage at room temperature for an equilibration period of about 5-7 days led to a decrease in the average UV-Vis transmission to a value of 65% before stabilizing. Similarly, at 50° C., an equilibration period of 3 days was observed before the average UV-Vis transmission stabilized to a value of 63%. Further storage of the nanoparticle dispersion concentrate at 50° C., did not lead to a further drop in transmission, and a stable transmission value was observed for at least three weeks after the initial equilibration period.

Example 2—Reacting the Cross-Linking Agent Before Emulsifying without Water 80.0 g of Huntsman Ethyleneamine E-100 was combined with 9.02 g trimethylolpropane triglycidyl ether, (crosslinking agent), and allowed to react to completion at 65° C. under constant stirring from an overhead mixer. In a separate vessel, 100.0 g of Chevron 100R was combined with 20.0 g of Hitec 1910b, a polymeric surfactant, which is 20% active ingredient in 80/SN100. The surfactant solution was thoroughly mixed until homogenous. After the crosslinking reaction had completed (about one hour), the surfactant solution was added to the E-100 solution under constant mixing. The mixture was then dispersed with high energy mixing using a M-110P Microfluidizer at 20-30 kPsi and a F20Y interaction chamber. This microfluidized solution will be referred to as a nanoparticle dispersion. A temperature controller was used to vary the temperature of the bath that surrounds the outlet coil and was set to 50° C. with the solution exiting around 46° C. The nanoparticle dispersion was collected in a separate vessel and run through the Microfluidizer another three additional passes and the final product was collected. An aliquot was taken from the final product to monitor stability at room temperature using the UV-Vis Transmission procedure outlined above. The nanoparticle dispersion initially had an average UV-Vis transmission of around 52% and dropped to about 48% after 21 days at about 20° C.

Example 3—In Situ Cross-Linking without Water 80.0 g of Huntsman Ethyleneamine E-100 was combined with 9.02 g of trimethylolpropane triglycidyl ether (cross-linking agent). In a separate vessel, 100.0 g of Chevron 100R was combined with 20.08 g of Hitec 1910B (available from Afton Chemical Co.), a polymeric surfactant which is 20% active ingredient in 80% SN100. The surfactant solution was thoroughly mixed until homogenous. The surfactant solution was added to the E-100 solution under constant mixing. The mixture was then dispersed with high energy mixing using a M-110P Microfluidizer at 20-30 kPsi and a F20Y interaction chamber. This microfluidized solution will be referred to as a nanoparticle dispersion. A temperature controller was used to vary the temperature of the bath that surrounds the outlet coil and was set to 50° C. with the solution exiting around 46° C. This nanoparticle dispersion was collected in a separate vessel, and allowed to react to completion at 65° C. under constant stirring from an overhead mixer. After one hour, the nanoparticle dispersion was run through the Microfluidizer an additional three passes and the final product was collected. An aliquot was taken from the final product to monitor stability at room temperature using the UV-Vis Transmission procedure outlined above. The nanoparticle dispersion initially had an average UV-Vis transmission of around 52%, after 68 days at about 20° C. the average transmission had decreased to 44%.

Example 4—Reacting the Cross-Linking Agent with E-100 in the Presence of Surfactant Before Emulsifying without Water 80.0 g of Huntsman Ethyleneamine E-100 was combined with 9.02 g of trimethylolpropane triglycidyl ether (cross-linking agent). In a separate vessel, 100.0 g of Chevron 100R was combined with 20.0 g of Hitec 1910B, a polymeric surfactant which is 20% active ingredient in 80% SN100. The surfactant solution was thoroughly mixed until homogenous. The surfactant solution was added to the E-100 solution under constant mixing and allowed to react to completion at 65° C. under constant stirring from an overhead mixer. After the crosslinking reaction has completed, about one hour, the mixture was dispersed with high energy mixing using a M-110P Microfluidizer at 20-30 kPsi and a F20Y interaction chamber. This microfluidized solution will be referred to as a nanoparticle dispersion. A temperature controller was used to vary the temperature of the bath that surrounds the outlet coil and was set to 50° C. with the solution exiting around 46° C. The nanoparticle dispersion was collected in a separate vessel and run through the Microfluidizer another three additional passes and the final product was collected. An aliquot was taken from the final product to monitor stability at room temperature using the UV-Vis Transmission procedure outlined above. The nanoparticle dispersion initially has an average UV-Vis transmission of around 50-90°/%.

Example 5—Reacting the Cross-Linking Agent after Emulsifying without Water 80.0 g of Huntsman Ethyleneamine E-100 was combined with 9.02 g of trimethylolpropane triglycidyl ether (cross-linking agent). In a separate vessel, 100.0 g of Chevron 100R was combined with 20.08 g of Hitec 1910b, a polymeric surfactant which is 20% active ingredient in 80% 100R. The surfactant solution was thoroughly mixed until homogenous. The surfactant solution was added to the E-100 solution under constant mixing. The mixture was dispersed with high energy mixing using a M-110P Microfluidizer at 20-30 kPsi and a F20Y interaction chamber. A temperature controller was used to vary the temperature of the bath that surrounds the outlet coil and was set to 50° C. with the solution exiting around 46° C. This nanoparticle dispersion was collected in a separate vessel, and was run through the Microfluidizer an additional three passes. The nanoparticle dispersion was collected and allowed to react to completion at 65° C. under constant stirring from an overhead mixer. After the reaction has completed, in one hour, the nanoparticle dispersion was the final product. An aliquot was taken from the final product to monitor stability at room temperature using the UV-Vis Transmission procedure outlined above. The nanoparticle dispersion initially has an average UV-Vis transmission of around 50-90%.

Example 6—Reacting the Cross-Linking Agent Before Emulsifying 60.0 g of Polysciences branched polyethyleneimine (1200 MW, product number 06088; PEI) was combined with 2.71 g of trimethylolpropane triglycidyl ether (crosslinking agent). In a separate vessel, 100.0 g of Chevron 100R was combined with 20.0 g of a calcium salt of a branched alkyl benzenesulfonate, an anionic surfactant which is 50% active ingredient in 50%/o AMEXOM100. The surfactant solution was thoroughly mixed until homogenous with the aid of heat. The PEI solution was allowed to react to completion at 65° C. under constant stirring from an overhead mixer. After one hour the reaction had completed, and 20.0 g of distilled water was added to the PEI containing solution. Mixing PEI containing solution and distilled water caused the solution to heat up, so the solution was allowed to cool back to room temperature (i.e. 18-22° C.). When cool, the surfactant solution was added to the aqueous solution under constant mixing. The mixture was then dispersed with high energy mixing using an M-100P Microfluidizer at 20-30 kPsi and a F20Y interaction chamber. A temperature controller was used to vary the temperature of the bath that surrounds the outlet coil and was set to 50° C. with the solution exiting the outlet coil at around 46° C. This microfluidized solution will be referred to as the nanoparticle dispersion. This nanoparticle dispersion was collected in a separate vessel and run through the Microfluidizer another three additional passes and the final product was collected. An aliquot was taken from the final product to monitor stability at room temperature and 50° C. using the UV-Vis Transmission procedure outlined above. A 1 mass % dilution of the concentrated nanoparticle dispersion in Chevron 100R had an initial average UV-Vis transmission of 93.9%.

Example 7

A non overbased, calcium branched alkyl benzene sulphonate surfactant (6 g, % Ca) was added to Chevron 100R base oil (12 g) and heated to 60° C. with stirring until it fully dissolved, under an $N_2$ blanket. Polyethyleneimine solution (5 g, in water at 50 mass %) was added dropwise to the calcium sulfonate solution over 5 minutes while ultrasonic mixing was applied using a Branson 450 Sonifier, while cooling to maintain the temperature. After additional ultrasonic mixing was applied for a further 2 minutes during which time trimethylolpropene triglycidyl ether (2 g) was added. The resulting solution was held at 60° C., while being stirred at 300 rpm, for 3 hours to ensure full reaction of the trimethylolpropane triglycidyl ether. The product was characterized by dynamic light scattering (DLS), ASTM D4739 and ASTM D664.

Using the same general process described in Example 7, above, a series of materials were prepared, as shown in Table 1:

TABLE 1

| | Example | | | | |
|---|---|---|---|---|---|
| | 8 | 9 | 10 | 11 | 12 |
| Surfactant Type | Calcium Sulfonate | Calcium Sulfonate | Calcium Sulfonate | Calcium Sulfonate | Calcium Sulfonate |
| Surfactant (mass %) | 20 | 20 | 20 | 20 | 20 |
| Amine Solution (mass %) | 40 | 40 | 40 | 40 | 40 |
| PEI* mw (daltons) | 10000 | 10000 | 10000 | 1200 | 800000 |
| Amine Dilution (in water) | 50 | 50 | 75 | 50 | 50 |
| Crosslinking Agent | TMP GE* | TMP GE | TMP GE | TMP GE | TMP GE |
| Mol % amine crosslinked | 15 | 40 | 40 | 40 | 15 |
| Particle size (nm by DLS) | 229 | 265 | 357 | 162 | 927 |
| Neat TBN D4739 (mg KOH/g) | 230 | 211.2 | 309.6 | 220.8 | 216 |

*polyethyleneimine
**inmethylpropane glycidyl ether

It should be noted that the compositions of this invention comprise defined, individual, i.e., separate, components that may or may not remain the same chemically before and after mixing. Thus, it will be understood that various components of the composition, essential as well as optional and customary, may react under the conditions of formulation, storage or use and that the invention also is directed to, and encompasses, the product obtainable, or obtained, as a result of any such reaction.

The disclosures of all patents, articles and other materials described herein are hereby incorporated, in their entirety, into this specification by reference. The principles, preferred embodiments and modes of operation of the present invention have been described in the foregoing specification. What applicants submit as their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. An oleaginous dispersion of nanoparticles with a core comprised primarily of an organic base, immobilized within a surfactant layer.

2. The dispersion, as claimed in claim 1, wherein said organic base comprises polyamine.

3. The dispersion of claim 1, wherein said organic base is at least partially crosslinked.

4. The dispersion of claim 3, wherein from about 0.5 mol % to about 80 mol % of said organic base is crosslinked.

5. The dispersion of claim 2, wherein said polyamine is at least partially crosslinked.

6. The dispersion of claim 2, wherein from about 0.5 mol % to about 80 mol % of said polyamine is crosslinked.

7. The dispersion of claim 2, wherein said polyamine has an average molecular weight of from about 100 Daltons to about 1,000,000 Daltons.

8. The dispersion of claim 1, wherein surfactant layer comprises one or more surfactants having a phase inversion temperature (PIT) outside the range of from about −35° C. to about 300° C.

9. The dispersion of claim 1, wherein said surfactant layer comprises one or more ionic surfactants selected from sultanate, phenate, sulfurized phenate, thiophosphonate, salicylate and naphthenate metal salts.

10. The dispersion of claim 8, wherein said surfactant layer comprises one or more non-ionic surfactants.

11. The dispersion of claim 10, wherein said surfactant layer comprises one or more olefin and ethylene-α-olefin polymers functionalized with at least one polar functional group.

12. The dispersion of claim 11, wherein said surfactant layer comprises one or more olefin and ethylene-α-olefin polymers functionalized with at least one polar functional group selected from polyalkenyl oligomers and polymers substituted with one or more carboxylic acid groups, or anhydrides thereof, and polyalkenyl oligomers or polymers having one or more amine, amine-alcohol or amide polar moieties attached to the polymer backbone, optionally through a bridging group.

13. The dispersion of claim 1, wherein said uncrosslinked aminic core of said nanoparticles has an average molecular weight of from about 100 Daltons to about 1,000,000 Daltons.

14. The dispersion of claim 1, wherein the ratio (mass %:mass %) of core to surfactant of said nanoparticles is from about 0.1:1 to about 24:1.

15. The dispersion of claim 2, wherein the ratio (mass %:mass %) of core to surfactant of said nanoparticles is from about 0.1:1 to about 24:1.

16. The dispersion of claim 6, wherein the ratio (mass %:mass %) of core to surfactant of said nanoparticles is from about 0.1:1 to about 24:1.

17. The dispersion of claim 1, wherein said nanoparticles have an average particle size of from about 5 nm to about 3000 nm, as measured via Transmission Electron Microscopy (TEM).

18. The dispersion of claim 6, wherein said nanoparticles have an average particle size of from about 5 nm to about 3000 nm, as measured via Transmission Electron Microscopy (TEM).

19. A dispersion of claim 1 having a TBN of active ingredient as measured in accordance with ASTM D4739 of from about 50 to about 900 mg KOH/g.

20. A dispersion of claim 2 having a TBN as measured in accordance with ASTM D4739 of from about 50 to about 900 mg KOH/g.

21. A dispersion of claim 4 having a TBN as measured in accordance with ASTM D4739 of from about 50 to about 700 mg KOH/g.

22. A dispersion of claim 7 having a TBN as measured in accordance with ASTM D4739 of from about 50 to about 700 mg KOH/g.

23. A dispersion of claim 9 having a TBN as measured in accordance with ASTM D4739 of from about 50 to about 700 mg KOH/g.

24. A dispersion of claim 12 having a TBN as measured in accordance with ASTM D4739 of from about 50 to about 700 mg KOH/g.

25. A dispersion of claim 13 having a TBN as measured in accordance with ASTM D4739 of from about 50 to about 700 mg KOH/g.

26. A lubricating oil composition for an internal combustion engine comprising an oleaginous nanoparticle dispersion of claim 19, in an amount contributing at least about 0.25 mg KOH/g of TBN to the lubricating oil composition.

27. An oleaginous dispersion of nanoparticles with a core comprised primarily of an organic base, immobilized within a surfactant layer, said organic base comprising polyamine having an average molecular weight of from about 100 Daltons to about 1,000,000 Daltons; from about 0.5 mol % to about 80 mol % of said polyamine being crosslinked; said surfactant layer comprising one or more ionic surfactants having a phase inversion temperature (PIT) outside the range of from about −35° C. to about 300° C. selected from sulfonate, phenate, sulfurized phenate, thiophosphonate, salicylate and naphthenate metal salts; wherein said nanoparticles have an average particle size of from about 5 nm to about 3000 nm, as measured via Transmission Electron Microscopy(TEM) and a ratio (mass %:mass %) of core to surfactant of said nanoparticles is from about 0.1:1 to about 24:1; and said oleaginous dispersion has a TBN of active ingredient as measured in accordance with ASTM D4739 of from about 50 to about 900 mg KOH/g.

28. An oleaginous dispersion of nanoparticles with a core comprised primarily of an organic base, immobilized within a surfactant layer, said organic base comprising polyamine having an average molecular weight of from about 100 Daltons to about 1,000,000 Daltons; from about 0.5 mol % to about 80 mol % of said polyamine being crosslinked; said surfactant layer comprising one or more non-ionic surfactants having a phase inversion temperature (PIT) outside the range of from about −35° C. to about 300° C. selected from olefin and ethylene-α-olefin polymers functionalized with at least one polar functional group selected from polyalkenyl oligomers and polymers substituted with one or more carboxylic acid groups, or anhydrides thereof, and polyalkenyl oligomers or polymers having one or more amine, amine-alcohol or amide polar moieties attached to the polymer backbone, optionally through a bridging group; wherein said nanoparticles have an average particle size of from about 5 nm to about 3000 nm, as measured via Transmission Electron Microscopy (TEM) and a ratio (mass %:mass %) of core to surfactant of said nanoparticles is from about 0.1:1 to about 24:1; and said oleaginous dispersion has a TBN of active ingredient as measured in accordance with ASTM D4739 of from about 50 to about 900 mg KOH/g.

* * * * *